US007642703B2

(12) United States Patent
Middleton et al.

(10) Patent No.: US 7,642,703 B2
(45) Date of Patent: Jan. 5, 2010

(54) LAMP BASE

(75) Inventors: Jeffrey L. Middleton, Dover, PA (US); Jay Yeaple, York, PA (US); Neil Bupp, Manchester, PA (US); Donald Burger, York, PA (US); Tad Smith, Manchester, PA (US); Timothy McGill, Dover, PA (US)

(73) Assignee: OSRAM Sylvania Inc., Danvers, MA (US)

( * ) Notice: Subject to any disclaimer, the term of this patent is extended or adjusted under 35 U.S.C. 154(b) by 398 days.

(21) Appl. No.: 11/515,455

(22) Filed: Aug. 31, 2006

(65) Prior Publication Data

US 2008/0054780 A1 Mar. 6, 2008

(51) Int. Cl.
*H01J 5/48* (2006.01)

(52) U.S. Cl. ..... 313/318.01; 439/611; 439/615

(58) Field of Classification Search ..... 313/318.01, 313/318.03; 439/611, 615
See application file for complete search history.

(56) References Cited

U.S. PATENT DOCUMENTS 5,032,759 A * 7/1991 Thiry et al. ..... 313/318.03
5,969,469 A * 10/1999 Wang ..... 313/318.01
2002/0195918 A1* 12/2002 Matsuba et al. ..... 313/318.01

* cited by examiner

*Primary Examiner*—Joseph L Williams
*Assistant Examiner*—Fatima N Farokhrooz
(74) *Attorney, Agent, or Firm*—William H. McNeill

(57) ABSTRACT

A lamp base (10), for example, for a tungsten-halogen lamp, comprises three electrically conductive parts or elements and a glass insulator. Specifically, the lamp base (10) comprises a first metallic outer part (12), a glass inner part (14), an electrically conducting eyelet (18), and an upper electrically conductive part (20), all symmetrically arrayed about a longitudinal axis (16). The glass insulator (14) bonds all of the electrically conductive parts, (12, 18) and (20). The metallic outer part (12) is preferably threaded for insertion into a socket and has a major, internal diameter D1. The glass inner part (14) has a primary, external diameter that is equal to the major internal diameter D1; i.e., the external diameter of the glass inner part (14) is contiguous with the internal diameter of the metallic outer part (12). Further, the internal glass part (14) has an opening (14*a*) therein and the opening (14*a*) has a secondary diameter D2In an aspect of the invention, D2/D1 is greater than 0.5 and less than 0.6 and, in the preferred embodiment of the invention, the ratio D2/D1 is 0.58.

4 Claims, 1 Drawing Sheet

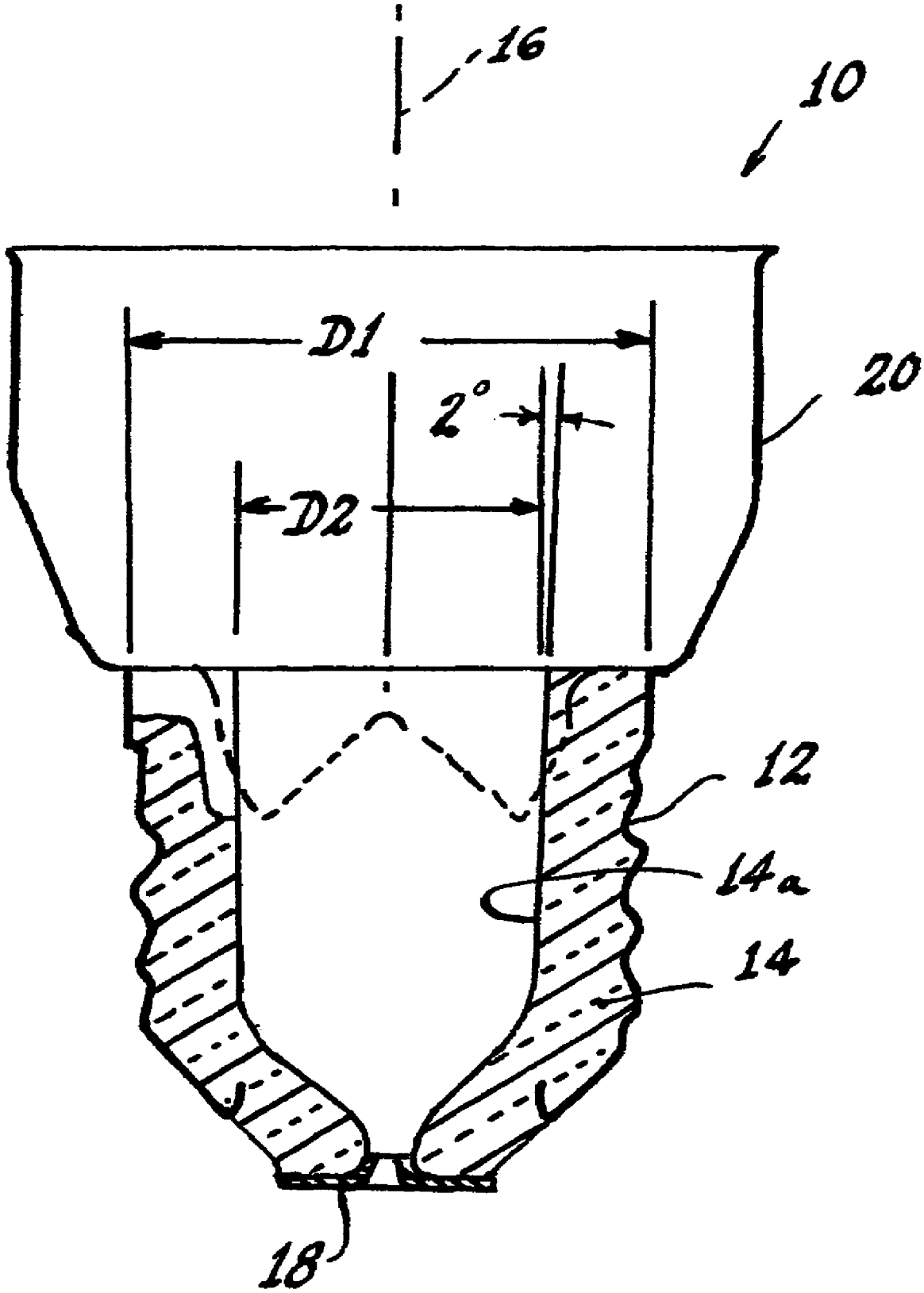
16
10
D1
2°
20
D2
12
14a
14
18

LAMP BASE

TECHNICAL FIELD

This invention relates to lamp bases and more particularly to lamp bases formed to receive a printed circuit board while, at the same time, retaining good insulating properties and sound structural integrity.

BACKGROUND ART

Among incandescent lamps, those operating on the well-known halogen cycle are among the most efficient. When certain operating parameters of the lamps are controlled by external circuitry, the lamps can be made to operate even more efficiently. If such circuitry could be included within the lamp or the lamp base, it would provide a saving in space and increase operational usage of such lamps. It would be an advance in the art if these advantages could be achieved without taking away from the strength of the lamp.

DISCLOSURE OF INVENTION

It is, therefore, an object of the invention to obviate the disadvantages of the prior art.

It is another object of the invention to enhance the usability of lamps.

These objects are accomplished, in one aspect of the invention, by a lamp having a lamp base comprising a metallic outer part and a glass inner part, the improvement comprising: said metallic outer part having a major diameter D1 and said glass inner part having a primary diameter equal to D1 and a secondary diameter D2, wherein D2/D1 is greater than 0.5.

Increasing the secondary diameter of the glass inner part provides a space for the reception of a printed circuit board for controlling the operation of the lamp; however, the increase must be within limits or the insulating capability and the structural integrity of the lamp base would be compromised.

BRIEF DESCRIPTION OF THE DRAWINGS

The single FIGURE is an elevational, cross-sectional view of a lamp base according to an aspect of the invention.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Referring now to the drawing with greater particularity, there is shown in the FIGURE a lamp base 10, for example, for a tungsten-halogen lamp. The base 10 comprises three electrically conductive parts or elements and a glass insulator. Specifically, the lamp base 10 comprises a first metallic outer part 12, a glass inner part 14, an electrically conducting eyelet 18, and an upper electrically conductive part 20, all symmetrically arrayed about a longitudinal axis 16. The glass insulator 14 bonds all of the electrically conductive parts, 12, 18 and 20.

The metallic outer part 12 is preferably threaded for insertion into a socket and has a major, internal diameter D1. The glass inner part 14 has a primary, external diameter that is equal to the major internal diameter D1; i.e., the external diameter of the glass inner part 14 is contiguous with the internal diameter of the metallic outer part 12. Further, the internal glass part 14 has an opening 14*a* therein and the opening 14*a* has a secondary diameter D2. In an aspect of the invention, D2/D1 is greater than 0.5 and less than 0.6 and, in the preferred embodiment of the invention, the ratio D2/D1 is 0.58.

In prior art lamp bases it was usual for the ration D2/D1 to be 0.47, resulting in a much greater amount of glass being utilized and leaving no room for a printed circuit board.

In part to maintain sufficient strength for the base 10, the draft angle for the opening 14*a* was decreased from 3° to 2°. The metallic outer part 12, which is usually referred to as the shell, is made from aluminum or brass having a thickness of 0.010" (0.254 mm) and is quite fragile until assembled with its glass interface.

Thus there is provided a base for a lamp, which base is rugged and capable of accepting a printed circuit to increase the efficiency of a lamp.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. In a lamp base comprising a metallic outer part and a glass inner part arrayed about a longitudinal axis, the improvement comprising:

said metallic outer part having a major, internal diameter D1 and said glass inner part having a primary external diameter equal to D1 and a longitudinal opening therein having a secondary diameter D2, wherein D2/D1 is 0.58.

2. The lamp base of claim 1 wherein said metallic outer part is threaded.

3. The lamp base of claim 1 wherein said secondary diameter D2 tapers inwardly over at least a part of its length.

4. The lamp base of claim 3 wherein said taper is 2°.

* * * * *